US007137227B2

(12) United States Patent
Franz

(10) Patent No.: US 7,137,227 B2
(45) Date of Patent: Nov. 21, 2006

(54) STRUCTURAL BRACE

(76) Inventor: Robert Michael Franz, 1264 S. Johnson Way, Lakewood, CO (US) 80232

( * ) Notice: Subject to any disclaimer, the term of this patent is extended or adjusted under 35 U.S.C. 154(b) by 356 days.

(21) Appl. No.: 10/604,506

(22) Filed: Jul. 27, 2003

(65) Prior Publication Data

US 2005/0016112 A1 Jan. 27, 2005

(51) Int. Cl.

| | |
|---|---|
| ***E04H 1/00*** | (2006.01) |
| ***E04H 14/00*** | (2006.01) |
| ***E04H 3/00*** | (2006.01) |
| ***E04H 5/00*** | (2006.01) |
| ***E04H 6/00*** | (2006.01) |

(52) U.S. Cl. ..... 52/243.1; 52/665; 52/712; 52/714; 52/713; 52/167.1; 248/298.1; 248/241

(58) Field of Classification Search ..... 403/3, 403/80, 85, 102; 248/300, 298.1, 241, 250; 52/243.1, 656.9, 665, 712, 714, 664, 291, 52/733.1, 713, 573.1, 167.1

See application file for complete search history.

(56) References Cited

U.S. PATENT DOCUMENTS

| | | | | |
|---|---|---|---|---|
| 0,887,912 | A | 5/1908 | Boker | |
| 3,492,766 | A | 2/1970 | Andrews | |
| 3,861,632 | A * | 1/1975 | Siilats | 248/224.7 |
| 4,103,463 | A | 8/1978 | Dixon | |
| 4,881,352 | A | 11/1989 | Glockenstein | |
| 5,040,345 | A | 8/1991 | Gilmour | |
| 5,079,884 | A | 1/1992 | Menchetti | |
| 5,090,170 | A | 2/1992 | Propst | |
| 5,140,792 | A | 8/1992 | Daw et al. | |
| 5,228,254 | A | 7/1993 | Honeycutt, Jr. | |
| 5,237,786 | A | 8/1993 | Kochansky | |
| 5,313,752 | A | 5/1994 | Hatzinikolas | |
| 5,377,461 | A | 1/1995 | DeGrada et al. | |
| 5,685,121 | A * | 11/1997 | DeFrancesco et al. | 52/731.9 |
| 5,743,063 | A * | 4/1998 | Boozer | 52/713 |
| 5,906,080 | A * | 5/1999 | diGirolamo et al. | 52/243.1 |
| 5,921,056 | A * | 7/1999 | Weiss et al. | 52/745.16 |
| 5,924,259 | A * | 7/1999 | Marousek | 52/656.1 |
| 5,966,893 | A * | 10/1999 | Quillin | 52/713 |
| 6,119,430 | A | 9/2000 | Nicholls | |
| 6,122,871 | A | 9/2000 | Russell et al. | |
| 6,131,359 | A * | 10/2000 | Duff | 52/706 |
| 6,158,179 | A | 12/2000 | Ackerly et al. | |
| 6,213,679 | B1 * | 4/2001 | Frobosilo et al. | 403/403 |
| 6,402,420 | B1 * | 6/2002 | Yang | 403/381 |

* cited by examiner

*Primary Examiner*—Carl D. Friedman
*Assistant Examiner*—Chi Q. Nguyen
(74) *Attorney, Agent, or Firm*—Roger A. Jackson

(57) ABSTRACT

A structural brace apparatus and method provides support between a primary building component and a secondary building component, the primary building component having X and Y axis deflections relative to the secondary building component. The brace includes a first support arm having a longitudinal axis, the first arm extending from and adapted to be secured to the primary building component, the first arm longitudinal axis being positioned at an intermediate angle between the primary building component X and Y axis deflections. The brace also includes a second support arm extending from and adapted to be secured to the secondary building component, the second arm has a slidable engagement with the first arm for reciprocative movement substantially parallel to the first arm longitudinal axis, wherein the brace is operative to reduce transmission of the X and Y axis deflections from the primary building component to the secondary building component.

20 Claims, 2 Drawing Sheets

STRUCTURAL BRACE

TECHNICAL FIELD

The present invention relates to generally to structural brace apparatus used in building construction. More particularly, the present invention relates to a flexible structural brace apparatus that is secured between a primary building component and a secondary building component, wherein the primary building component has X axis and Y axis deflection relative to the secondary building component that can be caused from structural live and dead loading, creep, temperature extremes, earth settling, rain, snow, earthquake, wind, and the like. The structural brace apparatus is operative to reduce transmission of the X axis and Y axis deflection from the primary building component to the secondary building component.

BACKGROUND OF INVENTION

Building structures have numerous deflections, due to the various sizes, materials of construction, and different loadings that a building structure can experience. In particular, multistory structures can experience the different loadings from floor to floor, which results in relatively different deflections between the different floor structures. As there is usually a need for vertical wall structures that are typically non load bearing between the floors, the wall structures must of necessity be structurally attached to the floor and ceiling of a particular level within the building structure. As the aforementioned wall structure is attached to the floor and ceiling which have correspondingly different deflections, these different deflections can transmit into the wall structure causing a wall structure to deflect, crack, or buckle. Thus, there is a need for a way of securing the wall structure to the floor and ceiling, however, requiring at least some degree of flexibility in the securing of the wall structure to allow for the building structure to deflect at relatively different rates from the floor to the ceiling. As is well known in the art, building structural deflection rarely occurs in a singular axis or direction, as most building structures are constructed of lateral beams that are supported by a pair of a freely pivoting attachments which allows the beam to bend from its loading without transmitting the beam bending moment into the other parts of the building structure, meaning that the beam bends in a parabolic profile, which of necessity causes varying degrees of structural deflection at varying points along the beam length. This also results in beam deflections not only vertically but laterally also. Thus, it is very important that a structural brace be designed to accommodate deflection in more than one axis while still providing some measure of support between the two building components.

Accommodating building structural deflections in the support of vertical walls has long been recognized in the prior art, however, the prior art has focused almost exclusively upon vertical only deflections between building structure components that act to support a vertical wall, while providing some degree of lateral or horizontal stability in conjunction with vertical flexibility. One example would be U.S. Pat. No. 5,685,121 to De Francesco et al. that discloses a metal wall stud extension ceiling connector that slides to compensate for ceiling deflection in the event of earthquakes, or other deflections. The extension is positioned vertically and the sliding feature of the metal wall said is designed to accommodate only vertical ceiling deflection. In this same vein, U.S. Pat. No. 6,119,430 to Nicholls also discloses a slidably engaged metal stud wherein the slidable portion is more central to the stud length, which allows a higher degree of vertical deflection to occur in the stud. A further example is in U.S. Pat. No. 5,906,080 to di-Girolamo et al. that discloses a shouldered sliding bracket that typically attaches to the end of a wall stud, wherein the slidable bracket is attached to a ceiling structure, again only designed to accommodate purely vertical deflection of the ceiling structure. A further prior art example is in U.S. Pat. No. 5,313,752 to Hatzinikolas the discloses a wall framing system wherein slidably engaged attachments are affixed to the end of vertical wall studs to allow a limited degree of vertical flexure in the wall, thus accommodating vertical only structural wall flexing between the floor and ceiling of a building structure. Another example is in U.S. Pat. No. 5,040,345 to Gilmour that discloses an end mounted stud clip for allowing vertical floating movement between a floor and a roof structure utilizing a slidable engagement between a C shaped or channel type metal stud in which the stud clip is slidably engaged into. A final example is in U.S. Pat. No. 5,237,786 to Kochansky that discloses an interior wall system that utilizes in one embodiment a plate cylinder within a cylinder having a guide rod that is spring loaded to allow again, only vertical deflection between the floor and ceiling.

What is needed is a structural brace apparatus that can accommodate not only vertical deflections between building components but in addition horizontal or lateral deflections between building components, that result in a combined axes composite deflection between the building components that acts at an angle intermediate to the building component X axis deflection and the building component Y axis deflection. This is required because building structural component deflections are rarely in a singular axis, as the most typical deflection being a beam that deflects in a somewhat parabolic shape resulting in vertical and horizontal deflections, i.e. X axis and Y axis deflections. Thus, a structural brace apparatus is required to accommodate both X axis and Y axis deflections from a building component in an effort to help reduce transmission of these multiple access deflections into another building component to prevent damage to that component, therefore allowing of freedom of movement between the two building components to reduce stress and fracture occurring between the components that are connected by a structural brace apparatus, while the same time providing a measure of some structural support between the building components. Additional desirable features would be the ability of the structural brace apparatus to accommodate a large degree of the flex and at the same time having a retention mechanism to keep the structural brace apparatus from disengaging where it has a slidable engagement.

SUMMARY OF INVENTION

The present invention is a structural brace apparatus adapted to provide flexible support between a primary building component and a secondary building component, with the primary building component having X axis and Y axis deflection relative to the secondary building component. The structural brace apparatus includes a first support arm having a longitudinal axis, the first support arm extends from and is adapted to be secured to the primary building component, the first support arm longitudinal axis being positioned at an intermediate angle between the primary building component X axis and Y axis deflections. The structural brace apparatus also includes a second support arm extending from and adapted to be secured to the secondary building component, the second support arm has a slidable engagement with the first support arm for reciprocative movement that is substantially parallel to the first support arm longitudinal axis, with the reciprocative movement being relative to the first support arm. The structural brace apparatus is operative to reduce transmission of the X and Y axis deflections from the primary building component to the secondary building component.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
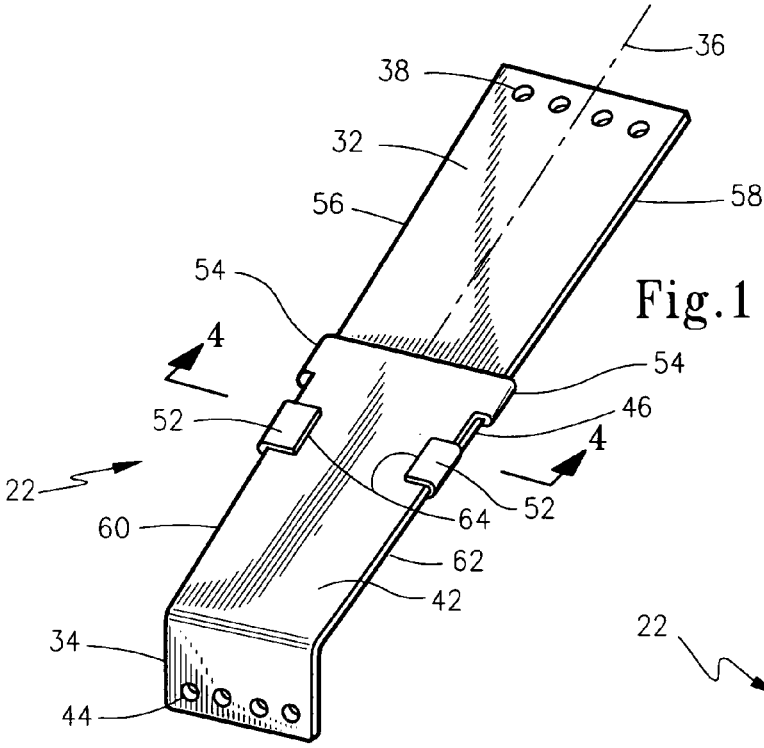
FIG. 1 shows a perspective view of a structural brace apparatus assembly as viewed from the building component side.

22 Structural Brace Apparatus
24 Primary building component
26 Secondary building component
28 Primary building component X axis deflection
29 Resultant primary building component deflection angle
30 Primary building component Y axis deflection
31 Resultant primary building component deflection
32 First support arm
34 Base attachment member
36 First support arm longitudinal axis
38 Means for securing first support arm to primary building component
40 Intermediate angle from first support arm longitudinal axis position to the primary building component X axis deflection
42 Second support arm
44 Means for securing second support arm to the secondary building component
46 Slidable engagement between the first support arm and the second support arm
48 Reciprocative movement
50 Angle of second support arm attachment to the secondary building component
52 First support arm slidable engagement retainer
54 Second support arm slidable engagement retainer
56 First support arm outer first edge margin
58 First support arm outer second edge margin
60 Second support arm outer third edge margin
62 Second support arm outer fourth edge margin
64 Finger inward extension
66 Geometric plane of primary building component X axis and Y axis deflections

DETAILED DESCRIPTION

Figure 3:
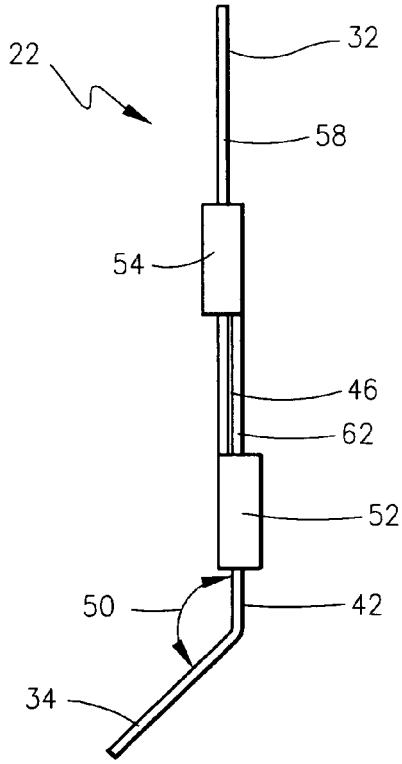
FIG. 3 shows a side view of the structural brace apparatus assembly.
Figure 2:
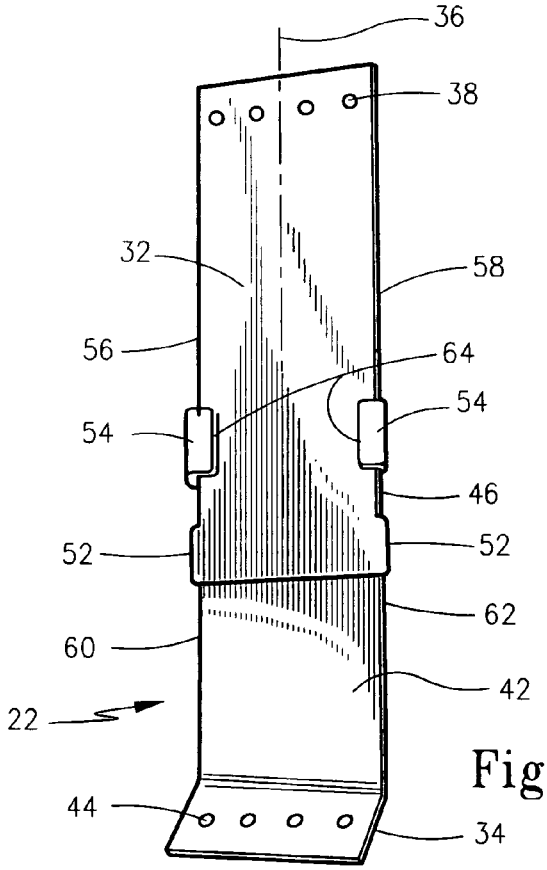
FIG. 2 shows a perspective view of the structural brace apparatus assembly as viewed from a side opposite of the building component side.
Figure 5:
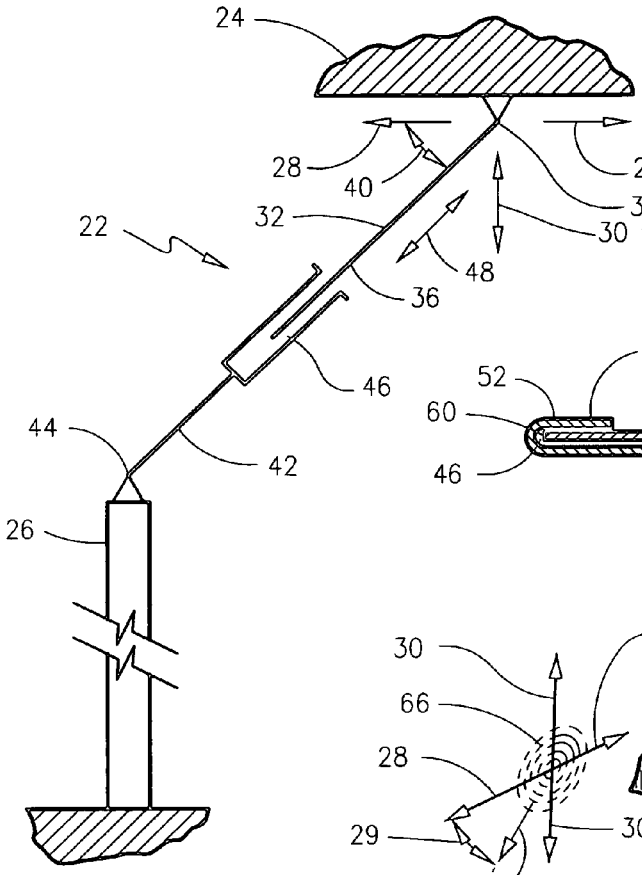
FIG. 5 shows a schematic representation of the structural brace apparatus assembly secured between the primary building component and the secondary building component.
Figure 4:
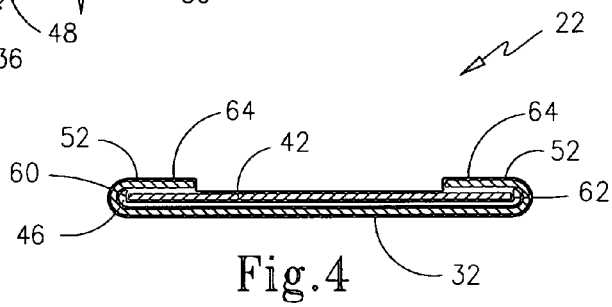
FIG. 4 shows crossectional view 4—4 from FIGS. 1 and 6 depicting a slidable engagement between a fist support arm and a second support arm.
Figure 6:
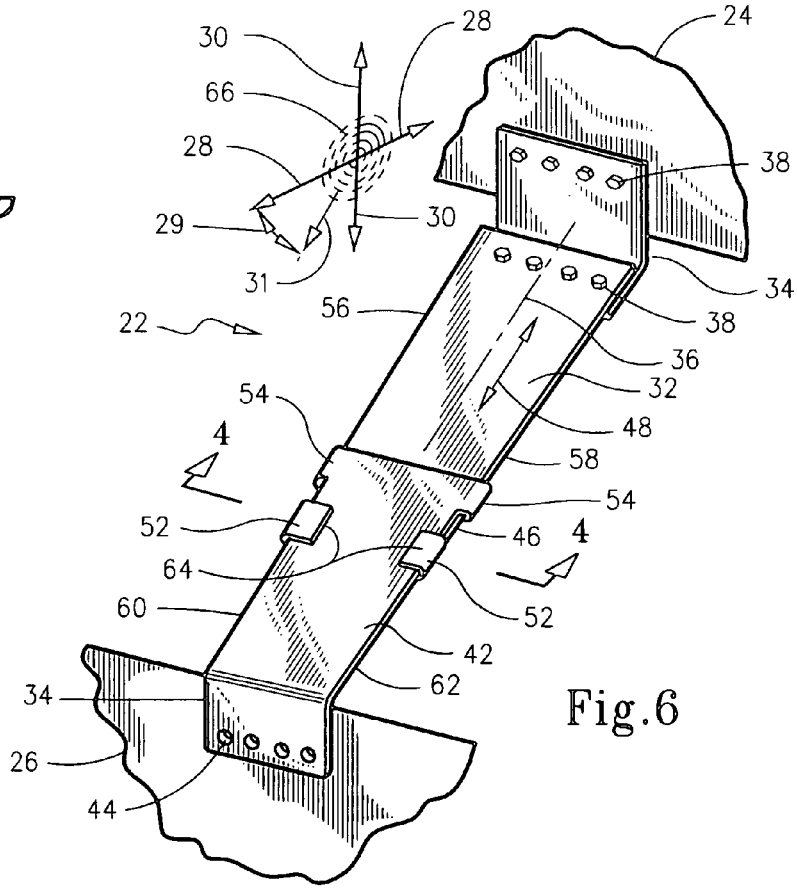
FIG. 6 shows a perspective view of the structural brace apparatus assembly in use secured between the primary building component and the secondary building component.

With reference to FIGS. 1–6 shown is a perspective view of the structural brace apparatus assembly 22 as viewed from the building component side in FIG. 1, with FIG. 2 showing another perspective view of the structural brace apparatus assembly 22 as viewed from a side opposite of the building component side, also FIG. 3 shows a side view of the structural brace apparatus assembly 22, FIG. 4 shows a crossectional view 4—4 from FIGS. 1 and 6 of the structural brace apparatus assembly 22 that details the slidable engagement between the fist support arm 32 and the second support arm 42, FIG. 5 shows the schematic representation of the structural brace apparatus assembly 22 secured between the primary building component 24 and the secondary building component 26, and FIG. 6 shows a perspective view of the structural brace apparatus assembly 22 in use secured between the primary building component 24 and the secondary building component 26.

The structural brace apparatus 22 is adapted to provide flexible support between a primary building component 24 and a secondary building component 26, with the primary building component 24 having X axis 28 and Y axis 30 deflections relative to the secondary building component 26, as best shown in FIGS. 5 and 6. Thus, the purpose of structural brace apparatus 22 is to accommodate not only substantially vertical deflections defined as Y axis deflections 30 between the primary building component 24 relative to the secondary building component 26, but in addition substantially horizontal or lateral deflections defined as X axis deflections 28 also relative to the secondary building component 26, that result in a combined axes composite resultant deflection 31 in approximately a single geometric plane 66. Note that the primary building component 24, X axis 28 and Y axis 30 deflections relative to the secondary building component 26 are shown for clarity in FIGS. 5 and 6, however, any combination of the aforementioned X axis 28 and Y axis 30 deflections resulting in a resultant composite deflection 31 in any direction anywhere approximately within the geometric plane 66 of the primary building component 24 relative to the secondary building component 26 could be accommodated by the structural brace apparatus 22 in providing a flexible support between the primary building component 24 and the secondary building component 26. This would be typically, but not limited to an application wherein the primary building component 24 is represented by a floor or roof structural member of a building structure and the secondary building component 26 is represented by an interior wall structure that is supported by a floor with a freestanding wall upper portion, with the freestanding upper wall portion being attached to the second support arm 42 as best shown in FIGS. 5 and 6. As the structural brace apparatus 22 is normally installed in a plurality in quantity, the multiple structural braces 22 act to brace and provide support for the freestanding portion of the wall being the secondary building component 26, while at the same time not transmitting the resultant primary building component deflection 31 into the secondary building component 26. The resultant primary building component deflection 31 can stem from bending moments of the beams or structure that can comprise the primary building component 24, typically resulting from live loading, and/or dead loading, related to weight loading on the roof or floor from people, equipment, snow, wind, and the like. This is desired because the primary building component 24 deflections are rarely in a singular axis, as the most typical deflection being a beam that deflects in a somewhat parabolic shape resulting in horizontal 28 and vertical 30 deflections, respectively the X axis 28 and Y axis 30 deflections. Thus, the structural brace apparatus 22 accommodates the resultant primary building component deflection 31 in an effort to help reduce transmission of the resultant primary building component deflection 31 to help prevent damage to the secondary building component 26, therefore allowing a freedom of movement between the primary building component 24 and the secondary building component 26 to reduce stress and fracture occurring between the primary building component 24 and the secondary building component 26 connected by the structural brace apparatus 22. At the same time the structural brace apparatus 22 provides a measure of some structural support between the primary building component 24 and the secondary building component 26. The structural brace apparatus 22 can accommodate relatively large deflections of the resultant primary building component deflection 31 without transmitting the resultant primary building component deflection 31 into the secondary building component 26. Of necessity, a minimal amount of flex is desirable in both the first support arm 32 and the second support arm 42 to accommodate the slight angular 40 and complementary angle 50 change of the first support arm 32 and the second support arm 42 due to the relative aforementioned deflection between the primary building component 24 and the secondary building component 26 as best shown in FIG. 5, reference the schematic representation of fixed pivots being the means 38 for securing the first support arm 32 to the primary building component 24 by the use of fasteners or any other acceptable attachment in the construction arts, and the means 44 for securing the second support arm 42 to the secondary building component 26 by the use of fasteners or any other acceptable attachment in the construction arts. Note, that the angle 50 is complementary to the angle 40 which is the intermediate angle from the first support arm 32 longitudinal axis 36 position to the primary building component 24 depicted as angle 40 in FIG. 5 in between the primary building component 24 X axis deflection 28 and the first support arm 32 longitudinal axis 36, wherein angle 50 is the angle of the second support arm 42 attachment to the secondary building component 26, for purposes of description only angle 40 will referred to in the description, wherein it is understood that angle 50 is normally complementary to angle 40.

Moving in particular to the construction detail of the structural brace apparatus 22, the present invention includes the first support arm 32 that has a longitudinal axis 36, wherein the first support arm 32 extends from and is adapted to be secured to the primary building component 24. Also, the first support arm 32 longitudinal axis 36 is positioned at an intermediate angle 40 between the primary building component X axis deflection 28 and the primary building component Y axis deflection 30. In addition, the present invention includes the second support arm 42 that extends from and is adapted to be secured to the secondary building component 26. The second support arm 42 also has a slidable engagement 46 with the first support arm 32 for reciprocative movement 48 that is substantially parallel to the first support arm longitudinal axis 36, with the reciprocative movement 48 being relative to the first support arm 32. Wherein, the structural brace apparatus 22 is operative to reduce transmission of the X axis deflection 28 and Y axis deflection 30 from the primary building component 24 to the secondary building component 26. The aforementioned intermediate angle 40 allows the structural brace apparatus 22 to accommodate the combination of the X axis deflection 28 and Y axis deflection 30 from the primary building component 24 resulting in the resultant primary building component deflection 31 relative to the secondary building component 26. However, it is not mandatory that the intermediate angle 40 match the resultant primary component deflection 31 angle 29 to have the slidable engagement 46 be functional in addition to having some amount of flexure of the first support arm 32 and/or the second support arm 42 to accommodate the resultant primary building component deflection 31 relative to the secondary building component 26. In other words, if the intermediate angle 40 and the resultant primary deflection angle 29 are different, the structural brace apparatus 22 will still accommodate the primary building component deflection 31 relative to the secondary building component 26 requiring slightly more flexure of the first support arm 32 and/or the second support arm 42.

The materials of construction for the first support arm 32 and the second support arm 42 can be any number of general construction use steels or composites of varying cross sections perpendicular to the longitudinal axis 36 such as round, square, rectangular, elliptical, semi circular, channel section, L section, Z section, H section, I section, or any combination of the like. Also, the materials of construction can alternatively be coated with corrosion and/or fire resistant coatings. The materials of construction for a particular embodiment of the structural brace apparatus 22 include a first support arm 32 constructed of sheet stock having a longitudinal axis 36 with an outer first edge margin 56 and an opposing outer second edge margin 58 that are both substantially parallel to the longitudinal axis 36. Also, as previously described the first support arm 32 extends from and is adapted to be secured to the primary building component 24, with the first support arm 32 longitudinal axis 36 being positioned at an intermediate angle 40 between the primary building component X axis deflection 28 and the primary building component Y axis deflection 30. Additionally, included in the structural brace apparatus 22 is a second support arm 42 constructed of sheet stock with an outer third edge margin 60 and an opposing outer fourth edge margin 62 that is substantially parallel to the longitudinal axis 36. The second support arm 42 extends from and is adapted to be secured to the secondary building component 26. The second support arm 42 also has a slidable engagement 46 with the first support arm 32 for reciprocative movement 48 that is substantially parallel to the first support arm longitudinal axis 36, with the reciprocative movement 48 being relative to the first support arm 32. Wherein, the structural brace apparatus 22 is operative to reduce transmission of the X axis deflection 28 and Y axis deflection 30 from the primary building component 24 to the secondary building component 26. The aforementioned intermediate angle 40 allows the structural brace apparatus 22 to accommodate the combination of the X axis deflection 28 and Y axis deflection 30 from the primary building component 24 resulting in the resultant primary building component deflection 31 relative to the secondary building component 26. However, it is not mandatory that the intermediate angle 40 match the resultant primary component deflection 31 angle 29 to have the slidable engagement 46 remain functional along with some amount of flexure of the first support arm 32 and/or the second support arm 42 to accommodate the resultant primary building component deflection 31 relative to the secondary building component 26. In other words, even of the intermediate angle 40 and the resultant primary deflection angle 29 are different the structural brace apparatus 22 will still accommodate the primary building component deflection 31 relative to the secondary building component 26 requiring slightly more flexure of the first support arm 32 and/or the second support arm 42. The materials of construction for the first support arm 32 and the second support arm 42 can be any number of general construction use steels or composites and alternatively can be coated with corrosion and/or fire resistant coatings.

Optionally, the slidable engagement 46 can include a retainer to prevent the first support arm 32 and the second support arm 42 from axially disengaging from one another in at least one direction along the longitudinal axis 36 in conjunction with the reciprocative movement 48 to either limit the amount of the resultant primary building component deflection 31 relative to the secondary building component 26 and/or to help prevent the first support arm 32 and the second support arm 42 from inadvertently separating during handling and assembly of the structural brace apparatus 22. Looking in further detail at the slidable engagement 46 for the aforementioned particular embodiment, a plurality of inwardly extending fingers 64 are utilized, with four such finger 64 positions described, note that any combination of at least two of the described fingers 64 are acceptable to create the slidable engagement 46. Starting with a finger 64 that extends from the first support arm 32 outer first edge margin 56 and slidably engages the second support arm 42 and the outer third edge margin 60. The other three inwardly extending fingers 64, are as follows; starting with a finger 64 extending from the first support arm 32 outer second edge margin 58 slidably engaging the second support arm 42 and the outer forth edge margin 62, or finger 64 extending from the second support arm 42 outer forth edge margin 62 slidably engaging the first support arm 32 and the outer second edge margin 58, or finger 64 extending from the second support arm 42 outer third edge margin 60 slidably engaging the first support arm 32 and the outer first edge margin 56. Thus, of the four finger inward extensions 64 described, normally at least any two of the four are required for the slidable engagement 46, with the possibility of any three of the four finger inward extensions 64 acceptable, or all of the four of the finger inward extensions 64 are acceptable, as is shown in FIGS. 1, 2, and 6. However, to create the optional retainer for the slidable engagement 46 for the aforementioned particular embodiment, it is required such that a plurality of the finger inward extensions 64 contact from the first support arm 32 and the second support arm 42 such that a retainer is created causing contact from the first support arm 32 retainer 52 to the second support arm 42 retainer 54 to prevent the first support arm 32 and the second support arm 42 from axially disengaging from one another in at least one direction along the longitudinal axis 36. What this requires is that one finger 64 extends from the first support arm 32 outer first edge margin 56 forming retainer 52 and slidably engages the second support arm 42 and the outer third edge margin 60 and that at least one other finger 64 extend from the second support arm 42 outer third edge margin 60 forming retainer 54 slidably engaging the first support arm 32 and the outer first edge margin 56, thus the two previously described fingers 64 will contact in one direction to prevent the first support arm 32 and the second support arm 42 from axially disengaging from one another in at least one direction along the longitudinal axis 36. Alternatively, another pair of fingers 64 could contact accomplishing the same result of retaining the first support arm 32 and the second support arm 42 from axially disengaging from one another in at least one direction along the longitudinal axis 36. This would be accomplished by one finger 64 extending from the first support arm 32 outer second edge margin 58 forming retainer 52 and slidably engages the second support arm 42 and the outer fourth edge margin 62 and that at least one other finger 64 extend from the second support arm 42 outer fourth edge margin 62 forming retainer 54 slidably engaging the first support arm 32 and the outer second edge margin 58, thus the two previously described fingers 64 will contact in one direction to prevent the first support arm 32 and the second support arm 42 from axially disengaging from one another in at least one direction along the longitudinal axis 36. Optionally, all four finger inward extensions 64, comprising a pair of retainer sets, each being the first support arm retainer 52 and the second support arm retainer 54 could be used as a retainer to prevent the first support arm 32 and the second support arm 42 from axially disengaging from one another in at least one direction along the longitudinal axis 36, creating two pairs of finger 64 contacts as in shown in FIGS. 1, 2, and 6.

To accomplish both the means 38 for securing the first support arm 32 to the primary building component 24 and the means 44 for securing the second support arm 42 to the secondary building component 26 an option is described for the structural brace apparatus 22 as having a base attachment member 34 that is adjacent to either of the first support arm 32 opposite of the slidable engagement 46 or from the second support arm 42 opposite of the slidable engagement 46. Wherein the base attachment member 34 is operable to secure either of the first support arm 32 to the primary building component 24 by the preferred use of fasteners or any other acceptable attachment in the construction arts, or the second support arm 42 to the secondary building component 26 again by the use of fasteners or any other acceptable attachment in the construction arts. The alternative attachments of the base attachment member 34 to either of the first support arm 32 opposite of the slidable engagement 46 or from the second support arm 42 opposite of the slidable engagement 46 can be accomplished in a number of ways, such as being affixed by welding, fasteners (as shown in FIG. 6 on the first support arm 32), being integral (as shown in FIG. 6 on the second support arm 42), or any other manner typically used in the building construction arts. The use of none or a single base attachment member 34 typically requires that one or two variable length structural extensions (not shown) be adjacent to either or both the first support arm 32 opposite of the slidable engagement 46 or from the second support arm 42 opposite of the slidable engagement 46 that does not have the base attachment member 34, as is shown in FIG. 1 for the first support arm 32. Attachment methods for the structural extension are like those for the base attachment member 34 to either the first support arm 32 opposite of the slidable engagement 46 or from the second support arm 42 opposite of the slidable engagement 46. The structural extension is operable in the same way as the base attachment member 34, allowing for the structural brace apparatus 22 to be secured to a distant primary building component 24 and/or secondary building component 26. The materials of construction for the base attachment member 34 are preferably the same as the materials of construction for the first support arm 32 and the second support arm 42. Alternatively, a pair of base attachment members 34 could be adjacent to both the first support arm 32 opposite of the slidable engagement 46 and from the second support arm 42 opposite of the slidable engagement 46. The attachment options for the pair of base attachment members 34 to the first support arm 32 opposite of the slidable engagement 46 and from the second support arm 42 opposite of the slidable engagement 46 are the same as described for attaching the base attachment member 34 to either of the first support arm 32 opposite of the slidable engagement 46 or from the second support arm 42 opposite of the slidable engagement 46 and for the base attachment members 34 to the primary and secondary building components. The pair of base attachment members 34 would be operable to secure both the first support arm 32 to the primary building component 24 and the second support arm 42 to the secondary building component 26 as shown in FIG. 6.

Also, to accomplish both the means 38 for securing the first support arm 32 to the primary building component 24 and the means 44 for securing the second support arm 42 to the secondary building component 26, as an alternative to control the mounting positional orientation of the structural brace apparatus 22 at an intermediate angle 40 between the primary building component 24 X axis deflection 28 and the primary building component 24 Y axis deflection 30, the intermediate angle 40 can be set at about forty five (45) degrees, as is best shown in FIG. 5 and 6. This setting of the intermediate angle 40 of about forty five (45) degrees can be facilitated by having the base attachment member 34 oriented at an angle of about forty five (45) degrees extended from the longitudinal axis 36 adjacent to either of the first support arm 32 opposite of the slidable engagement 46 or the second support arm 42 opposite of the slidable engagement 46, as is best shown in FIG. 6. The base attachment member 34 oriented at about forty five (45) degrees is operable to secure either of the first support arm 32 to the primary building component 24 by the use of fasteners or any other acceptable attachment in the construction arts, or the second support arm 42 to the secondary building component 26 again by the use of fasteners or any other acceptable attachment in the construction arts. The attachment methods of the base attachment member 34 oriented at an angle of about forty five (45) degrees to either the first support arm 32 opposite of the slidable engagement 46 or the second support arm 42 opposite of the slidable engagement 46 are as previously described for the base attachment member 34 not necessarily oriented at an angle of about forty five (45) degrees. Additionally, the previous description of the option to use a pair of base attachment members 34 adjacent to both the first support arm 32 opposite of the slidable engagement 46 and from the second support arm 42 opposite of the slidable engagement 46 would also apply to the use of the base attachment members 34 oriented at an angle of about forty five (45) degrees, also as shown in FIG. 6. Also, the previously described attachment methods for the use of the pair of base attachment members 34 not necessarily oriented at an angle of about forty five (45) degrees would apply to the use of the pair of base attachment members 34 oriented at an angle of about forty five (45) degrees. The pair of base attachment members 34 oriented at an angle of about forty five (45) degrees would be operable to secure both the first support arm 32 to the primary building component 24 and the second support arm 42 to the secondary building component 26 by the use of fasteners or any other acceptable attachment in the construction arts as shown in FIG. 6.

Method of Use

Looking to FIGS. 5 and 6 specifically for the method of installing the structural brace apparatus 22 between the primary building component 24 and the secondary building component 26, with the primary building component 24 having X axis deflection 28 and Y axis deflection 30 relative to the secondary building component 26, with the structural brace apparatus 22 being operational to reduce transmission of the primary building component 24 X axis deflection 28 and Y axis deflection 30 relative to the secondary building component 26. The first step would be to provide the structural brace apparatus 22, including the first support arm 32 and the second support arm 42, wherein the first support arm 32 and the second support arm 42 have a slidable engagement 46, the first support arm 32 is adapted to be secured to the primary building component 24 opposite of the slidable engagement 46 and the second support arm 42 is adapted to be secured to the secondary building component 26 opposite of the slidable engagement 46. The next step is to estimate the primary building component 24 X axis deflection 28 and the primary building component 24 Y axis deflection 30 relative to the secondary building component 26 and then followed by a step to secure the first support arm 32 opposite of the slidable engagement 46 to the primary building component 24 at an angle 40 intermediate to the previously estimated primary building component 24 X axis deflection 28 and the primary building component 24 Y axis deflection 30. Finally, a step to secure the second support arm 42 opposite of the slidable engagement 46 to the secondary building component 26. Optionally, the step to secure the first support arm 32 opposite of the slidable engagement 46 to the primary building component 24 at an angle 40 intermediate to the previously estimated primary building component 24 X axis deflection 28 and the primary building component 24 Y axis deflection 30 can be accomplished by securing the first support arm 32 at an angle of about forty five (45) degrees from the primary building component 24 X axis deflection 28.

CONCLUSION

Accordingly, the present invention of a Structural Brace Apparatus has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

The invention claimed is:

1. A structural brace apparatus adapted to provide flexible support between a primary building component and a secondary building component, the primary building component having X axis and Y axis deflections relative to the secondary building component, comprising:

(a) a first support arm constructed of sheet stock having a longitudinal axis with opposite outer first and second edge margins substantially parallel to the longitudinal axis, said first support arm extending from and adapted to be secured to the primary building component, the first support arm longitudinal axis being positioned at an intermediate angle, wherein said intermediate angle is about forty five (45) degrees from the first support arm longitudinal axis position to the primary building component x axis deflection; and (b) a second support arm constructed of sheet stock with opposite outer third and fourth edge margins substantially parallel to the longitudinal axis, said second support arm extending from and adapted to be secured to the secondary building component, said second support arm has a slidable engagement with said first support arm for reciprocative movement substantially parallel to the first support arm longitudinal axis, the reciprocative movement is relative to said first support arm, said slidable engagement is constructed of a plurality of inwardly extending fingers such that at least one finger extends from said first support arm first edge margin and slidably engages said second support arm and said third edge margin, wherein said plurality of fingers contact from said first support arm and second support arm such that a retainer is created to prevent said first support arm and said second support arm from axially disengaging from one another in at least one direction along the longitudinal axis, wherein said structural brace apparatus is operative to reduce transmission of the X and Y axis deflections from the primary building component to the secondary building component.

2. A structural brace apparatus according to claim 1 wherein said sheet stock material is steel.

3. A structural brace apparatus according to claim 1 wherein said slidable engagement is constructed of a plurality of inwardly extending fingers such that at least one finger extends from said first support arm second edge margin and slidably engages said second support arm and said fourth edge margin.

4. A structural brace apparatus according to claim 3 wherein said plurality of fingers contact from said first support arm and second support arm such that a retainer is created to prevent said first support arm and said second support arm from axially disengaging from one another in at least one direction along the longitudinal axis.

5. A structural brace apparatus according to claim 1 wherein said slidable engagement is constructed of a plurality of inwardly extending fingers such that at least one finger from said second support arm third edge margin and slidably engages said first support arm and said first edge margin.

6. A structural brace apparatus according to claim 1 wherein said slidable engagement is constructed of a plurality of inwardly extending fingers such that at least one finger from said second support arm fourth edge margin slidably engages said first support arm and said second edge margin.

7. A structural brace apparatus according to claim 1 further comprising a base attachment member adjacent to either of said first support arm opposite of said slidable engagement or said second support arm opposite of said slidable engagement, wherein said base attachment member is operable to secure either of said first support arm to the primary building component or said second support arm to the secondary building component.

8. A structural brace apparatus according to claim 7 wherein said base attachment member is affixed to either of said first support arm or said second support arm.

9. A structural brace apparatus according to claim 7 wherein said base attachment member is integral to either of said first support arm or said second support arm.

10. A structural brace apparatus according to claim 1 further comprising a pair of base attachment members adjacent to each of said first support arm opposite of said slidable engagement and said second support arm opposite of said slidable engagement, wherein said base attachment members are operable to secure said first support arm to the primary building component and said second support arm to the secondary building component.

11. A structural brace apparatus according to claim 10 wherein said base attachment members are affixed to said first support arm and said second support arm.

12. A structural brace apparatus according to claim 10 wherein said base attachment members are integral to said first support arm and said second support arm.

13. A structural brace apparatus according to claim 1 further comprising a base attachment member oriented at about forty five (45) degrees extended from the longitudinal axis adjacent to either of said first support arm opposite of said slidable engagement or said second support arm opposite of said slidable engagement, wherein said base attachment member is operable to secure either of said first support arm to the primary building component or said second support arm to the secondary building component.

14. A structural brace apparatus according to claim 13 wherein said base attachment member is affixed to either of said first support arm or said second support arm.

15. A structural brace apparatus according to claim 13 wherein said base attachment member is integral to either of said first support arm or said second support arm.

16. A structural brace apparatus according to claim 1 further comprising a pair of base attachment members oriented at about forty five (45) degrees extended from the longitudinal axis adjacent to each of said first support arm opposite of said slidable engagement and said second support arm opposite of said slidable engagement, wherein said base attachment members are operable to secure said first support arm to the primary building component and said second support arm to the secondary building component.

17. A structural brace apparatus according to claim 16 wherein said base attachment members are affixed to said first support arm and said second support arm.

18. A structural brace apparatus according to claim 1 wherein said base attachment members are integral to said first support arm and said second support arm.

19. A structural brace apparatus according to claim 1 wherein said first support arm is secured to the primary building component by fasteners.

20. A structural brace apparatus according to claim 1 wherein said second support arm is secured to the secondary building component by fasteners.

* * * * *